US006292152B1

(12) United States Patent
Cosenza et al.

(10) Patent No.: US 6,292,152 B1
(45) Date of Patent: Sep. 18, 2001

(54) DISK ANTENNA

(75) Inventors: John Cosenza, St. James, NY (US); John Kryspin, Hopatcong, NJ (US)

(73) Assignee: Phazar Antenna Corp., Ronkonkoma, NY (US)

( * ) Notice: Subject to any disclaimer, the term of this patent is extended or adjusted under 35 U.S.C. 154(b) by 0 days.

(21) Appl. No.: 09/162,549

(22) Filed: Sep. 29, 1998

(51) Int. Cl.[7] ..... H01Q 1/38
(52) U.S. Cl. ..... 343/745; 343/749; 343/899
(58) Field of Search ..... 343/700 MS, 789, 343/769, 745, 749, 750, 752, 899; H01Q 1/38

(56) References Cited

U.S. PATENT DOCUMENTS

| | | | | |
|---|---|---|---|---|
| 4,305,078 | * | 12/1981 | Jones et al. | 343/769 |
| 4,369,447 | | 1/1983 | Edney | 343/769 |
| 4,697,189 | | 9/1987 | Ness | 343/700 MS |
| 4,887,089 | | 12/1989 | Shibata et al. | 343/700 MS |
| 4,896,162 | | 1/1990 | Parham et al. | 343/749 |
| 4,994,817 | | 2/1991 | Munson et al. | 343/770 |
| 5,410,322 | | 4/1995 | Sonoda | 343/700 MS |
| 5,453,753 | | 9/1995 | Cosenza et al. | 343/765 |
| 5,539,418 | * | 7/1996 | Egashira et al. | 343/789 |
| 5,583,510 | | 12/1996 | Ponnapalli et al. | 343/700 MS |
| 5,621,419 | | 4/1997 | Meek et al. | 343/770 |
| 5,673,052 | | 9/1997 | Cosenza et al. | 343/700 MS |
| 5,706,016 | | 1/1998 | Harrison, II | 343/752 |

FOREIGN PATENT DOCUMENTS 1925083 11/1970 (DE) .

OTHER PUBLICATIONS

Abstract: JP 8139515 A.
Dorne & Margolin home page: http://www.dome.com/dmdr5–1.html: DM DR 5–1; CN 12; DR 4–1 Sep. 10, 1997.
Toko Home page; info@ tokoam. Com: DAC Series, 1996.
Morgan et al., 1994, IEEE Transactions on Antennas and Propagation, US, IEEE Inc., New York, 42(1):54–61.
Scharten et al., 1982, Archiv Fur Elektronic And Ubertragungstechnik, 36(2):153–60.
Griffin et al., 1982, Electronics Letters, 18(6):266–69.
Littlefield, 1997, RF Design, US, Cardiff Publishing Co., Englewood, Co., 20(5):74–6.

* cited by examiner

*Primary Examiner*—Michael C. Wimer
(74) *Attorney, Agent, or Firm*—Steve Cha; Klauber & Jackson

(57) ABSTRACT

A disk antenna for use in a PCMCIA card or the like having a disk made from conventional moldable plastics and a radiating element that has a low capacitive impedance relative the inductance of the antenna feed such that the tuning element is capacitive. The disk antenna maximizes the ratio of bandwidth to disk size by maximizing the surface area of the radiating element. The antenna is application specific in that it can be adapted for various environmental resonant variations.

14 Claims, 3 Drawing Sheets

DISK ANTENNA

BACKGROUND OF THE INVENTION

A. Field of the Invention

The present invention relates generally to a disk antenna, and more particularly to a disk antenna for use in spread spectrum and discrete frequency applications, such as a Wide-Local-Area-Networks (WLANs), portable computers, handheld data collection devices, and wearable communications devices.

B. Description of the Prior Art

With the advent of network communications systems and portable computing and communication devices, the market interest has turned toward wireless networks in which users are provided with the benefits of network computing without drawbacks of being physically connected to the network, thereby allowing for portable network devices. In meeting the demand for wireless network services, developers are faced with multiple problems. Crowding of radio frequency spectrum and government regulations limit the amount of spectrum available for such services. Currently in the U.S., the ISM (Industrial, Scientific and Medical) radio frequency spectrum in the 2.4–2.5 Giga-Hertz (Ghz) range provides an unregulated region in which wireless network development has occurred free from government regulations. As may be expected this spectrum is widely used by a variety of digital and analog communication systems resulting in a substantial amount of radio frequency noise. While analog voice systems are forgiving of such noise, digital communication systems are more sensitive to noisy operating environments.

Recently, the commercial development of communications systems using spread-spectrum techniques has provided a way for wireless communication to provide digital signals with a reliable communication link even when operating under radio interference noise within the desired radio frequency spectrum. However, spread spectrum systems in order to operate for their intended purpose require a communication bandwidth that is greater than the bandwidth of the transmitted signal. This allows for the transmitted signal to be spread across the communication bandwidth in way that isolates and distinguishes the transmitted signal from the radio interference noise.

In the past, the development of these system has focused primarily on the transceiver devices and digital modems for conveying the transmitted signal using the spread spectrum technique. However, as the demand for wireless networking applications have grown, the desire to implement these system in smaller and more portable devices have grown.

Transmission of the signal ultimately requires some type of antenna to resonate or receive the signal from the electromagnetic energy that makes up the radio spectrum. In portable-wireless network applications, it is also desirable that the antenna be unobtrusive so as to not detract from the aesthetic and functional designs of the systems which implement a wireless communication application.

Such antennas must be able to operate in applications where the position of the antenna is changing, thus the antenna must be able to transceive omni-directionally thereby allowing the user flexibility to move about while maintaining a connection with the digital network.

Applications for such antennas may require that the antenna be mounted internally within a portable device or contained within a computer cartridge, such as the PCMCIA card type cartridges which make up the current standard for portable and laptop computers.

Providing an antenna in such small environments such as a computer cartridge presents certain problems when scaling down the antenna dimensions. For example, the space allocated for the antenna may be only a fraction of the cartridge space which also accommodate the digital modem and transceiver equipment. This space limitation limits the size of the radiating element that makes up antenna which in turn limits the bandwidth or radio frequency range in which the antenna is useful. As indicated above, it is desirable to maintain a large communication bandwidth for spread spectrum techniques. Furthermore, limiting the size of the radiating element can cause the antenna to be more sensitive to radio frequency interference from the nearby environment such as the transceiver and digital modem components. The noise can cause the resonate frequency of the antenna to shift thereby causing the operating bandwidth of the antenna to shift out of its desired operating range. Because smaller sized antennas are already provided with a smaller bandwidth, such shifts can severely limit the useful radio frequency range available. Thus, need exists for a compensating means to tune or adjust the antenna to compensate for the RF interference from the operating environment.

A conventional antenna of the type suitable for small compact operating environments is the disk type antenna. However, disk antennas currently manufactured to meet the space requirements demanded by computer cartridge vendors are limited in operational bandwidth, thereby limiting the benefits from spread spectrum techniques. The limited bandwidth also serves to amplify the effect of RF interference which shifts the resonant frequency. Presently, application specific tuning of disk antennas is not practicable as it requires retooling of the manufacturing process. Thus, antenna manufactures have imposed strict environmental requirements on the orientation of the antenna in relation to other electronic components in the computer cartridge. Such requirements, while minimizing environmental RF interference, place restrictions on the designers of wireless networking cards. Such a trade-off often causes the designer to sacrifice antenna performance for other considerations. Thus, it is desirable to provide a disk antenna having a small footprint for computer cartridge applications, while maximizing bandwidth and compensating for noise caused by the operating environment.

OBJECTS AND SUMMARY OF THE INVENTION

An object of the present invention is to provide an antenna for use within a computer cartridge, or portable, hand-held devices, that maximizes the communication bandwidth for spread spectrum communication systems.

Another object of the present invention is to provide a disk antenna that is manufactured so as to operate wireless networking in a specific RF interference environment.

An advantage of the present invention is to provide a disk antenna which the bandwidth of the antenna is maximized in relation to the size of the antenna.

A further advantage is to provide an application-specific disk antenna that is easily configured to compensate for environmental RF interference.

In accordance with the objects and advantages of the present invention, a disk antenna includes a disk having a generally circular first and second surfaces and a channel extending through the disk between the first and second surface along a longitudinal axis of the disk. A radiating element, disposed on the first disk surface, is adapted to communicate a data signal through electromagnetic energy.

A feed pin, having proximate and distal ends, is operatively connected at the proximate end to the radiating element and extends through the channel to the distal end which is free from the disk. The antenna, advantageously, includes compensating means for adjusting the resonate frequency to compensate for environmental resonant variations.

In a preferred embodiment of the present invention, the compensating means is the radiating element which is formed to overlie a predetermined portion of the disk in order to alter the resonant frequency of the radiating element to compensate for environmental resonant variations.

It is further noted that the radiating element is formed to overlie the first disk surface and extend along the sides of the disk to increase surface area whereby the bandwidth of the antenna is increased.

A feature of the preferred embodiment is that the resonating element is formed from metallic paint painted onto the disk to cover a predetermined portion. Changes to the predetermined portion that is painted compensates for environmental RF interference.

Another feature is that the radiating element has a low capacitive impedance relative to the inductance of the feed pin such that the basic impedance of the antenna is generally inductive. A capacitor is provided to function as the tuning element.

Another feature of the present invention is that the generally inductive impedance of the antenna permits the use of low dielectric materials which are low in cost and are easy to manufacture using conventional injection molding techniques.

In an alternatively preferred embodiment of the present invention, the compensating means is an adjustable capacitor functioning as the tuning element.

The present invention can be more fully understood by reference to the following description and accompanying drawings, which form an integral part of this application:

BRIEF DESCRIPTION OF THE DRAWING(S)

DETAILED DESCRIPTION OF THE PREFERRED EMBODIMENT(S)

Figure 1:
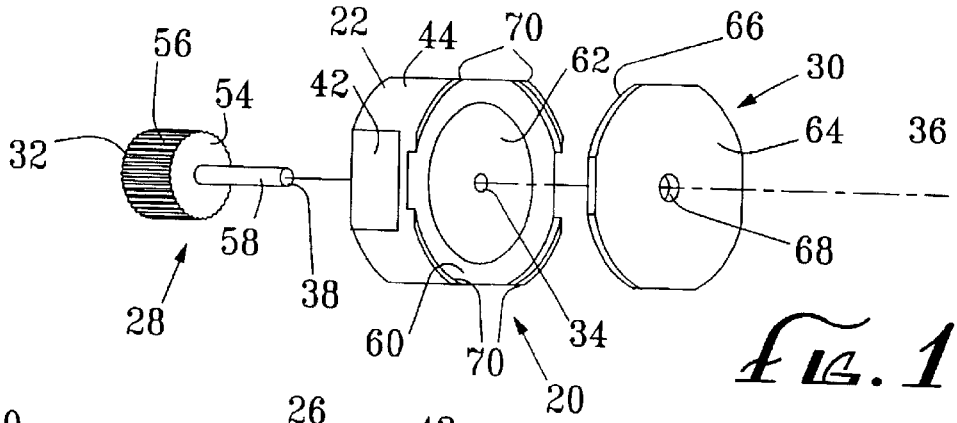
FIG. 1 is an exploded perspective view of a disk antenna of the present invention.
Figure 2:
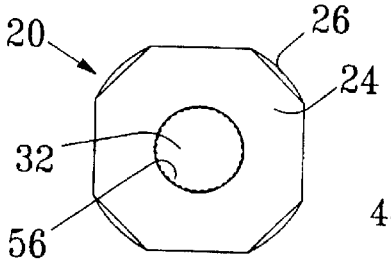
FIG. 2 is a top plan view of the disk antenna of FIG. 1.
Figure 3:
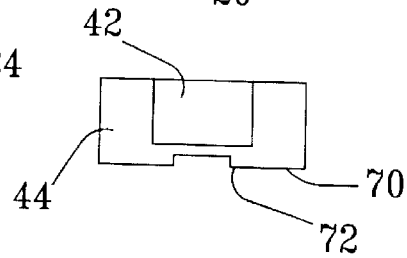
FIG. 3 is a side view of the disk antenna of FIG. 1.
Figure 4:
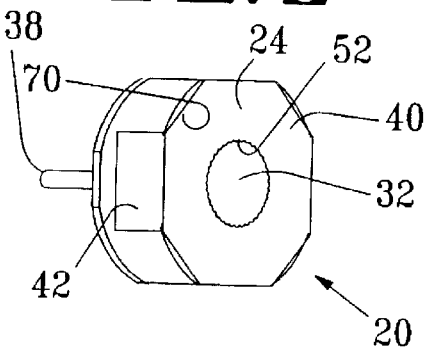
FIG. 4 is a perspective view the disk antenna of FIG. 1.

With reference to FIGS. 1–7 for purposes of illustration, there is shown generally in FIGS. 1–4 a disk antenna 20 having a generally cylindrical disk 22 on which a radiating element 24 overlies a generally circular first surface 26 and connects in circuit with an antenna feed 28 and tuning element 30. Advantageously, the disk antenna of the present invention, adapted for use in a computer cartridge, such as the PCMCIA card type, or portable hand-held devices, overcomes the disadvantages of conventional antennas by providing a means for compensating against RF interference created by other components in such devices and maximizes the operational bandwidth in relation to the size of the antenna.

In a preferred embodiment, the radiating element 24 comprises metallic paint that is painted onto the first surface 26 of the disk. The paint is preferable applied so that an even coating of metallic paint is formed overlying the first disk surface 26. The paint is preferably applied so as to cover a predetermined region of the disk which is preferably symmetrically centered about the antenna feed 28. In the present embodiment, the antenna feed 28 is provided by a feed pin 28 extending from a proximate end 32 in electrical contact with the radiating element 24 through a channel 34 formed along the longitudinal axis of the disk represented by line 36 to a free distal end 38. The paint forming the radiating element 24 is preferable applied using conventional silk-screening techniques which evenly distributes the paint within the predetermined area. However, other conventional painting techniques may be used to apply the paint as well. Preferable, some of the paint extends into the disk channel to ensure electrical contact between the radiating element 24 and the feed pin 28. It will be appreciated by those skilled in the art that paint thicknesses useful for forming the radiating element are consistent with good conductivity.

Other conventional methods for applying the radiating element may include, but are not limited to, electroplating or adhesion of a conductive foil.

Figure 5:
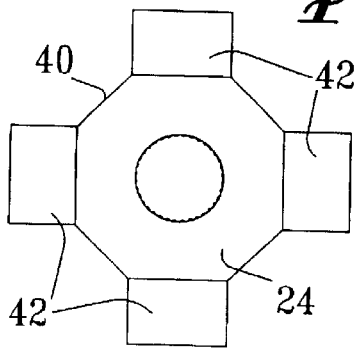
FIG. 5 is a plan view of the area defining a resonating element of the disk antenna of FIG. 1.

Referring to FIG. 5, a preferred foot print for the radiating element 24 includes a generally circular region 40 overlying the first disk surface 24 (FIGS. 1–4) and tabs 42 (FIG. 105) which extend over the sides 44 of the disk, perpendicular to the plane of the first disk surface 26. The tabs 42 increase the surface area of the radiating element 24, thereby, functioning to increase the operational bandwidth of the antenna. Thus, the preferred predetermined area for the radiating element 24 overlies the first disk surface 26 as well as a portion of the sides 44. The vertical tabs 42 allow current to flow over a longer distance causing the diameter of the disk antenna 20 to artificially larger and results in a greater bandwidth.

It should noted that it is desirable, but not necessary, to have the radiating element 24 formed in a symmetrical pattern centered about the feed pin 28. It is desirable due to the fact that as a symmetrical design results in an optimally symmetrical radiation pattern. As the size of the disk antenna is reduced relative to the wave length of the signal, the symmetry of the antenna becomes less critical.

It will be appreciated by those skilled in the art that adjustments to the size and shape of the radiating element 24 affects not only bandwidth and radiation patterns of the antenna, but can vary the resonant frequency of the antenna. It has been discovered that by varying the size and shape of the tabs 42 to change the predetermined area overlying the disk, the radiating element 24 functions as a means for compensating for environmental resonant variations that affect the resonant frequency of the antenna.

The feed pin 28 which extends through the disk channel 34 electrically connects the radiating element 24 to an RF transceiver (not shown). The size and shape of the feed pin 28 is largely determined by the means of attaching the feed pin to the radiating element and the transceiver, and by the electrical properties of the feed pin 28 in relation to the radiating element 24. With respect to the latter electrical properties FIG. 7, the radiating element is electrically characterized by a low capacitive impedance, as represented by the capacitor 46 and resistor 48 in FIG. 7, relative to the inductance of the feed pin, as represented by the inductor 50, resulting in a basic impedance for the combination of the radiating element 24 and feed pin 28 that is largely inductive. This allows for a tuning circuit 51 that is capacitive. In the presently preferred embodiment, the feed pin 28 is press fit into a counter-sink 52 formed in the disk channel 34 near the first disk surface 26. The feed pin 28 includes a head region 54 near the proximate end 32 fitted with ridges 56 about the perimeter to cause an interference fit within the counter-sink 52 region of the channel 34 that resists withdrawal. The press fit ensures electrical contact with the radiating element 24 which extends into a region of the channel 34 near the first disk surface 26. The body 58 of the feed pin 28 extends through the channel 34 and away from the disk to the distal free end 38 that connects to a transceiver. Preferable, the distal end 38 is sized and shaped to conform with the test pin for conventional transceiver diagnostic equipment. This allows for the antenna connection on the transceiver to serve as a test point prior to insertion of the antenna. This eliminates the need for designing a separate test pin connection into the transceiver circuit. A feed-pin body 58 diameter corresponding to a diagnostic test pin of the SMA Pin type is preferred.

Figure 6:
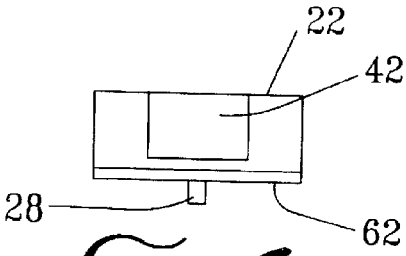
FIG. 6 is a side view of an alternate embodiment of a disk antenna having a tuning capacitor adhered to a disk according to the present invention.

Because the overall impedance of the resonating element 24 in series with the feed pin 28 is largely inductive, the tuning element 30 is a capacitor. The capacitor is located along a second disk surface 60. In a preferred embodiment, the capacitor is formed from a first electrically conductive plate 62 electroplated or painted onto a generally circular region of the second disk surface 60 centered about, and in electrical contact, with the center feed pin 28. The second plate 64 and dielectric 66 is provided by a conventional PC board having a polyester or epoxy laminate as the dielectric 66 with layers of tin plating overlying copper-cladding to form the second electrically conductive plate 64 overlying one side of the polyester laminate. The board is generally circular in shape and preferably conforms roughly to the shape of the second disk surface. An aperture 68 centrally located in the PC board allows for feed pin 28 to be maintained in spaced apart relation to the board which overlies the second disk surface 60 with the dielectric 66 being maintained between the first and second plates 62 and 64. The PC board can be maintained against the disk surface 60 by any conventional means including soldering and gluing. Such attachment means is illustrated by FIG. 6.

In the preferred embodiment the generally cylindrical shape of the disk is formed octagonally by eight generally flat side walls 44. Four of the walls made up of two sets of opposing side walls aligned perpendicularly in relation to each other when viewed across said disk surfaces provides raised flanges 70 extending beyond and away from the second disk surface 60. The flanges 70 are adapted with conventional securing elements 72 for press fitting the PC board onto the disk. The remaining four walls support the tabs 42 of the resonating element. The flat surfaces are preferred as they simplifying the resonating characteristics of the antenna and simplify the silk screening process.

Figure 7:
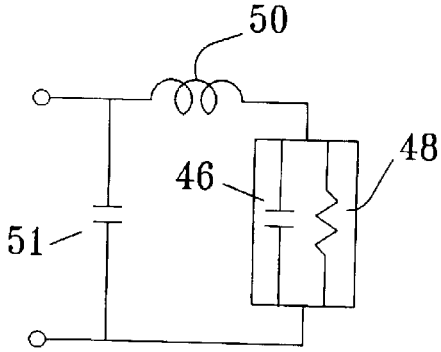
FIG. 7 is a schematic diagram of the equivalent electronic circuit of the disk antenna of FIG. 1.

Referring to FIG. 7, an equivalent electrical circuit for the disk antenna of includes the tuning circuit 51 in form of a capacitor connected across the feed pin 50 represented by an inductor in series with the resonating element represented by a resistor 48 in parallel with a capacitor 46. The preferred electrical specifications achieved from this circuit include:

- a tunable frequency range of 2.2 to 2.6 GHz, which includes the ISM band and other special applications in the U.S.; however other ranges may be desirable in other countries and other frequencies may be desirable in the U.S. for specific applications;
- a radiation pattern and gain equivalent to a quarter wave stub antenna;
- a power of 5 watts nominal; however, power levels are determined by application and most applications use less than 5 watts generally;
- where the nominal voltage standing wave ratio (VSWR) is 2 to 1 (2:1), having a typical bandwidth of 100 MHZ with the actual bandwidth of operation being a function of the environment in which the antenna is installed; and
- a polarization of which is predominantly vertical.

It should be noted that this circuit differs from conventional disk antennas in that the tuning element of conventional disk antennas is usually formed from of one or more inductors. In inductively tuned antennas, the disk is usually of a high dielectric constant which provides added cost to the manufacture of the antenna. A typically high dielectric constant material maybe a ceramic material having a dielectric in the general range of 20–24. High dielectric constant leads to a higher "Q" antenna and a lower operational bandwidth.

In the preferred embodiment (FIGS. 1–4) the disk 72 is manufactured from conventional injection molded plastic. An injection-moldable and microwave-grade plastic of the type having a typical dielectric constant preferably, but not necessarily, in the 2–4 range.

It will be appreciated that the disk antenna disclosed herein as being formed with components either silk screened or press fit onto the disk is substantially less costly to manufacture over other soldering and electroplating techniques. Furthermore, by making minor changes in the artwork on a silkscreen that makes up the overall shape of the resonating element 24, the antenna may be tuned to compensate for environmental resonant variations in the antenna using conventional techniques for correlating the resonant variations with the shape of the resonating element. Thus, by applying silk screens with various patterns, application specific disk antennas can be readily manufactured using conventional silk screening and press-fit manufacturing techniques resulting in almost no appreciable retooling of the manufacturing line.

In order to accommodate the antenna 20 in a computer cartridge or portable hand-held device, the disk antenna has a width between side walls of 0.583 inches; a thickness of 0.255 including the disk and tuning element; a feed pin length of 0.350; a radiating element covering a 0.645 radius from the feed pin on the first disk surface and tabs of 0.257 width and 0.190 away from the first disk surface; a first circular plate of 0.480 and a PC board equal generally in diameter to the molded disks. However, other sizes may be manufactured as required by specific applications.

TEST EXAMPLE(S)

Figure 8:
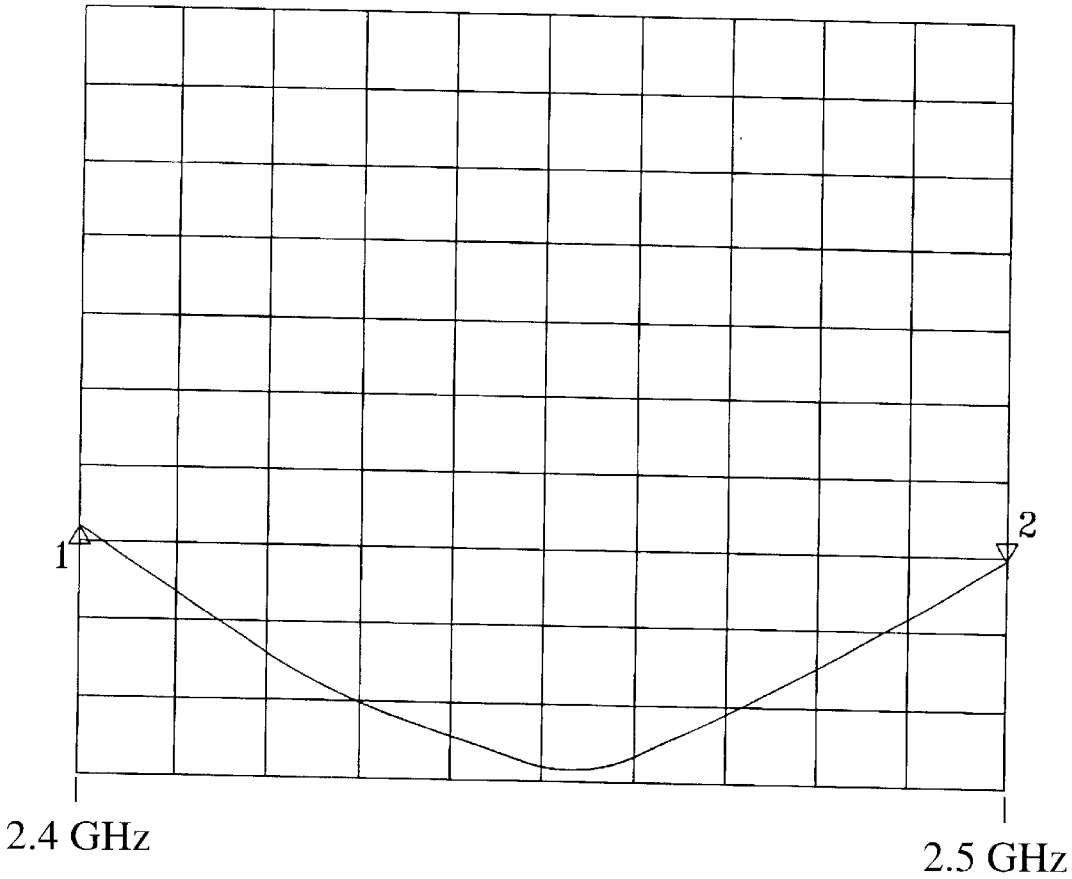
FIG. 8 is a plot over frequency showing the quality factor and bandwidth of a preferred embodiment of the present invention.

A test of the VSWR performance of a disk antenna of the preferred embodiment was made as shown in FIG. 8. The disk antenna according to the present invention had the physical and electrical dimensions of the preferred embodiment described above. As shown by FIG. 8, the disk antenna exhibited an overall bandwidth of 100 MHz where the VSWR was less than 2.5 to 1.

Figure 9:
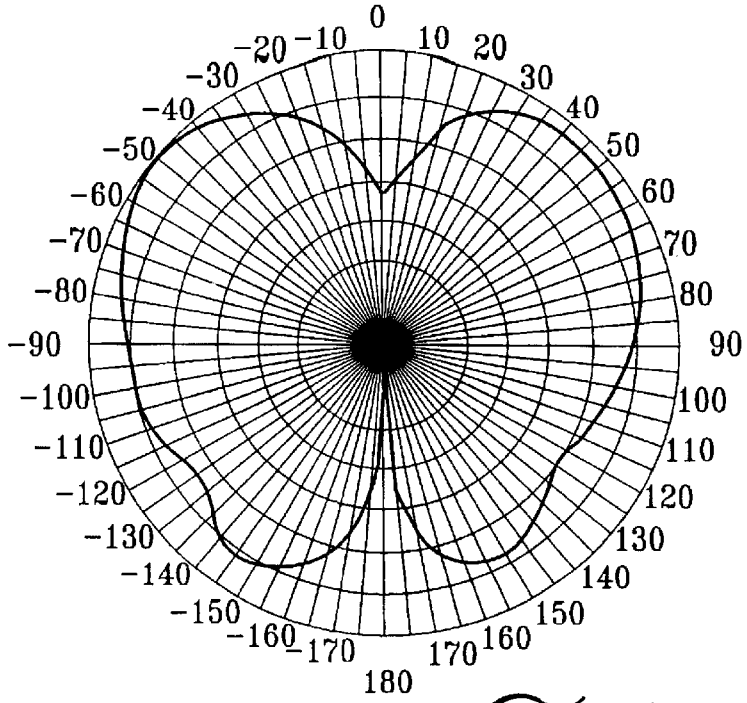
FIG. 9 is a smith chart showing the radiation pattern of a preferred embodiment.

The radiation pattern 80 for the preferred embodiment is shown in FIG. 9 and exhibits a monopole pattern equivalent to a quarter wave stub antenna.

Alternate Embodiment(s)

Figure 10:
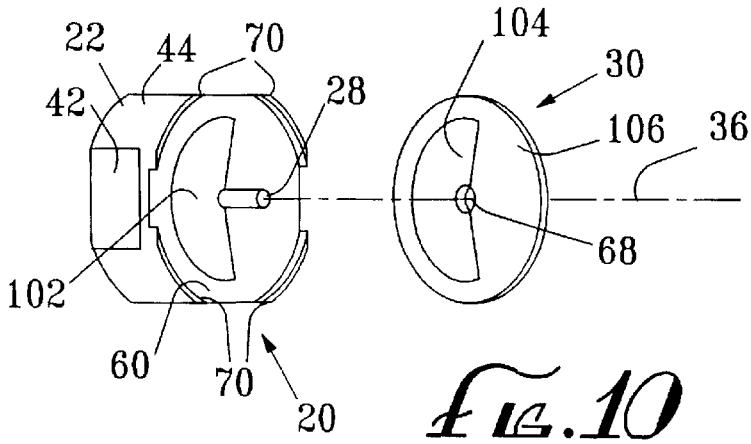
FIG. 10 is a side view of an alternate embodiment of a disk antenna having a variable capacitor according to the present invention.

In an alternative embodiment (FIG. 10) where like reference numerals refer to like components in the preferred embodiment, the tuning element 30 is an adjustable capacitor and functions as the means for compensating for the environmental resonant variations. In this embodiment the first plate of the capacitor is formed from two semi-circular electrically conductive portions 102 and 104. One portion formed on the second disk surface 60 and the second portion formed on the uncoated side 106 of the PC board 66. Each of the portions makes up a wedge comprising more than 50% of a circular region centered about the feed pin 28. The PC board 66 is attached to the disk 22 and rotatable about the feed pin 28 such that the two portions 102 and 104. are in overlapping relation. As the PC board 66 is rotated in relation to the disk 22 the effective surface area of the first plate is altered thereby adjusting the capacitance between the first plate 102 and 104 and second plate 64. In this embodiment, tuning of the antenna can occur during assembly of the antenna 20 with the computer cartridge rather than at the time of antenna manufacture.

Figure 11:
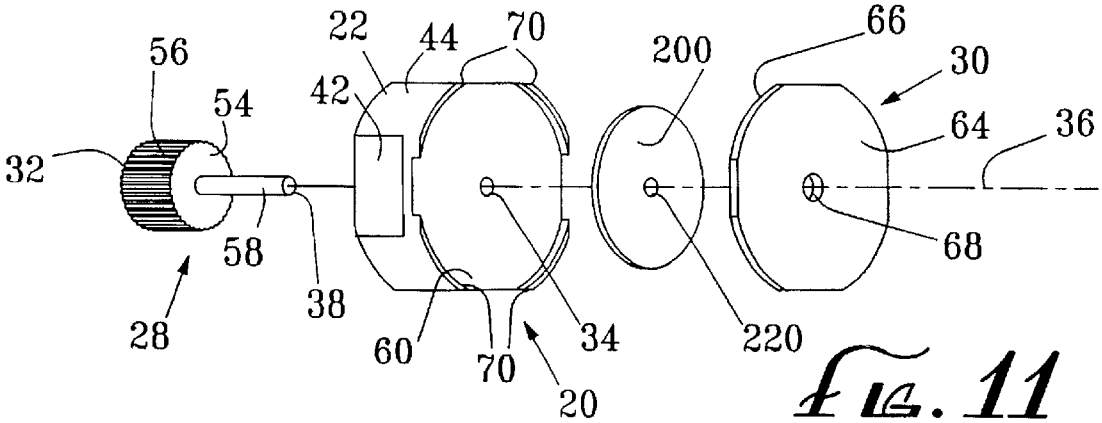
FIG. 11 is an exploded perspective view of a second alternative embodiment of a disk antenna having a capacitor according to the present invention.

In a second alternate embodiment (FIG. 11) where like reference numerals refer to like components in the preferred embodiment, the tuning element 30 is embodied in a capacitor having a first plate 200 of circular cut skin stock of 2 mil. thickness. A bore hole 220 extends through the center of the plate 200. The plate is in electrical contact with the feed pin 28 and is maintained between the disk 22 and PC board 66 when the PC board 66 is press fit against the disk 22.

While the invention has been described in terms of what are presently considered to be the most practical and preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A disk antenna comprising:

a disk having a generally circular first and second surface and a channel extending through said disk between said first and second surfaces along a longitudinal axis of said disk;

a radiating element adapted to communicate a data signal through electromagnetic energy disposed on said first disk surface;

a feed pin having a proximate and a distal end, said proximate end operatively connected to said radiating element and said distal end being free and extending through said channel;

a capacitor formed from an electrically conductive first plate located along said second disk surface connected in circuit with said feed pin;

an electrically insulative material overlying said first plate and an electrically conductive second plate overlying said insulative material and said insulative material and said second plate having a bore hole for receiving said feed pin in spaced relation to said second plate;

wherein said capacitor functions as a tuning element; wherein said disk includes a plurality of flanges disposed along the outer perimeter of said second surface adapted to secure said second plate press fittably therebetween; and, wherein said second plate is attached to said insulative material and said first plate includes a first portion attached to said disk and a second portion attached to said insulative material, said insulative material and said second portion of said first plate being movable in relation to said disk and said first portion of said first plate.

2. The disk antenna of claim 1 wherein said first plate is metallic paint.

3. The disk antenna of claim 2 wherein said first plate is silk screened onto said disk.

4. The disk antenna of claim 1 wherein said first plate is an electroformed metal deposited on said disk.

5. The disk antenna of claim 1 wherein said first plate is a metal plate.

6. The disk antenna of claim 1 wherein said disk includes means for retaining said insulative material and said second plate.

7. The disk antenna of claim 1 wherein said insulative material is attached to said second plate.

8. The disk antenna of claim 1 wherein said first plate is secured between said disk and second plate.

9. The disk antenna of claim 1, wherein said tuning element defines compensating means for adjusting a resonant frequency to compensate for environmental resonant variations.

10. The disk antenna of claim 9, wherein said compensating means is a variable capacitor tuning element.

11. The disk antenna of claim 9 wherein said compensating means is said radiating element being formed to overlie a predetermined portion of said disk in order to alter the resonant frequency of said radiating element to compensate for said environmental resonant variations.

12. The disk antenna of claim 11, wherein said radiating element is a metallic paint silk screened onto said first disk surface.

13. The disk antenna of claim 9, wherein said disk having sides forming a generally cylindrical outer surface and said radiating element includes tabs extending past said first disk surface and along said sides.

14. The disk antenna of claim 13, wherein said generally cylindrical outer surface is octagonal.

* * * * *